United States Patent [19]

Wrycraft et al.

[11] 4,129,236

[45] Dec. 12, 1978

[54] CONTAINER WITH SPOUT CONNECTION

[75] Inventors: Norman E. Wrycraft, Malton; Alistair K. Collins, Willowdale, both of Canada

[73] Assignee: Vulcan Industrial Packaging Limited, Rexdale, Canada

[21] Appl. No.: 809,301

[22] Filed: Jun. 23, 1977

[30] Foreign Application Priority Data

Jun. 29, 1976 [GB] United Kingdom ..... 26989/76

[51] Int. Cl.[2] ..... B65D 25/40

[52] U.S. Cl. ..... 222/570; 222/568; 285/245; 285/201; 220/320

[58] Field of Search ..... 220/319, 320, 288; 222/566, 567, 568, 570, 562, 573, 153; 285/245, 247, 386, 201-203; 403/342; 215/331

[56] References Cited

U.S. PATENT DOCUMENTS

| | | | |
|---|---|---|---|
| 2,721,003 | 10/1955 | Linton | 222/567 |
| 3,182,843 | 5/1965 | Foye | 215/331 |
| 3,186,604 | 6/1965 | Pentesco | 222/567 |

FOREIGN PATENT DOCUMENTS

| | | | |
|---|---|---|---|
| 1102863 | 2/1968 | United Kingdom | 222/562 |

*Primary Examiner*—Stanley H. Tollberg
*Assistant Examiner*—H. Grant Skaggs
*Attorney, Agent, or Firm*—Ridout & Maybee

[57] ABSTRACT

Spout for a container, e.g. a gasoline can, is formed as a one-piece plastics moulding with a flared skirt on the base formed with a circumferential groove that snap-couples tightly onto a bead on a raised metal neck on the can. A screw-threaded locking collar engages on a screw thread on the spout and can be tightened down to hold the skirt tightly engaged on the bead.

4 Claims, 3 Drawing Figures

CONTAINER WITH SPOUT CONNECTION

FIELD OF THE INVENTION

The present invention relates to a container with a spout connection.

There are known plastics containers having detachable pouring spouts which can be held releasably in a firmly seated position on the container through a screw-threaded engagement. Plastics containers are not always suitable for holding liquids such as gasoline and metal containers are preferred for this purpose. It can, however, be advantageous to use a plastics pouring spout, but the known arrangements for connecting and sealing the spout to metal container bodies are not entirely satisfactory.

When the plastics spout is formed with a screw thread, it is found that the relatively soft plastics material tends to wear rapidly in repeated use when engaged with the hard metal of the cooperating screw thread.

One example of a prior proposal for attaching a spout to a can body is shown in U.S. Pat. No. 133,635, Delany, where a threaded collar retains a flanged spout against the upper surface of an externally threaded boss. U.S. Pat. No. 3,486,503, Porter et al., shows a similar coupling arrangement intended for use with a plastics nozzle. If a plastics threaded member is used on a metal body, however, these arrangements are subject to the problem of wear discussed above, and moreover, these devices are not always convenient to assemble, since the spout or nozzle has to be held in position while the threaded member is brought into engagement with the container body.

Allen in U.S. Pat. No. 2,670,885 and Punte in U.S. Pat. No. 2,813,644 show plastics spouts which are tightly sealed on metal can bodies. The spouts are, however, intended to be permanently fixed and cannot be removed by normal hand pressure.

U.S. Pat. No. 2,033,931 to Erne shows a dispensing spout which clips around the open end of a metal can, and Kneusel U.S. Pat. No. 2,873,897 shows a plastics spout which clips onto a raised neck on a can. Such arrangements rely on the resiliency of the spout material to retain the spout, and this may not be sufficiently secure for all purposes.

The applicants are also aware of U.S. Pat. No. 2,721,003 to Linton. This device has a sealing portion including downwardly-depending bulbous-ended spring fingers formed on their outer side with screw-thread ribs, and a threaded clamping cup can be tightened down so as to press the bulbous ends of the fingers against the neck of the bottle below a bead on the neck. This prior suggestion is, however, a complex structure better adapted for use with a metal cap attaching to a glass neck of a bottle.

SUMMARY OF THE INVENTION

The spout connection of the invention employs a raised metal neck on the container, and this couples with a one-piece spout molded of plastics material, which has a flared skirt at the base and a circumferential groove.

The neck is formed with a bead, and the spout is molded of stiffly bendable plastics, so that the flared skirt can be snapped over the bead and in this position will engage tightly in a firm snap-coupling engagement, with the bead on the neck enclosed in the groove. A locking member is movable axially on the spout to a position which resists outward flexure of the skirt, so that the snap coupling cannot be released until the locking member is retracted. An intermediate shoulder portion on the spout engages sealingly on the top of the metal neck, so that no gaskets are required, and the spout and its locking member can be manufactured relatively simply using generally conventional molding techniques. Moreover, the connection is free from any projections inside the metal neck of the container.

DESCRIPTION OF THE PREFERRED EMBODIMENT

Figure 2:
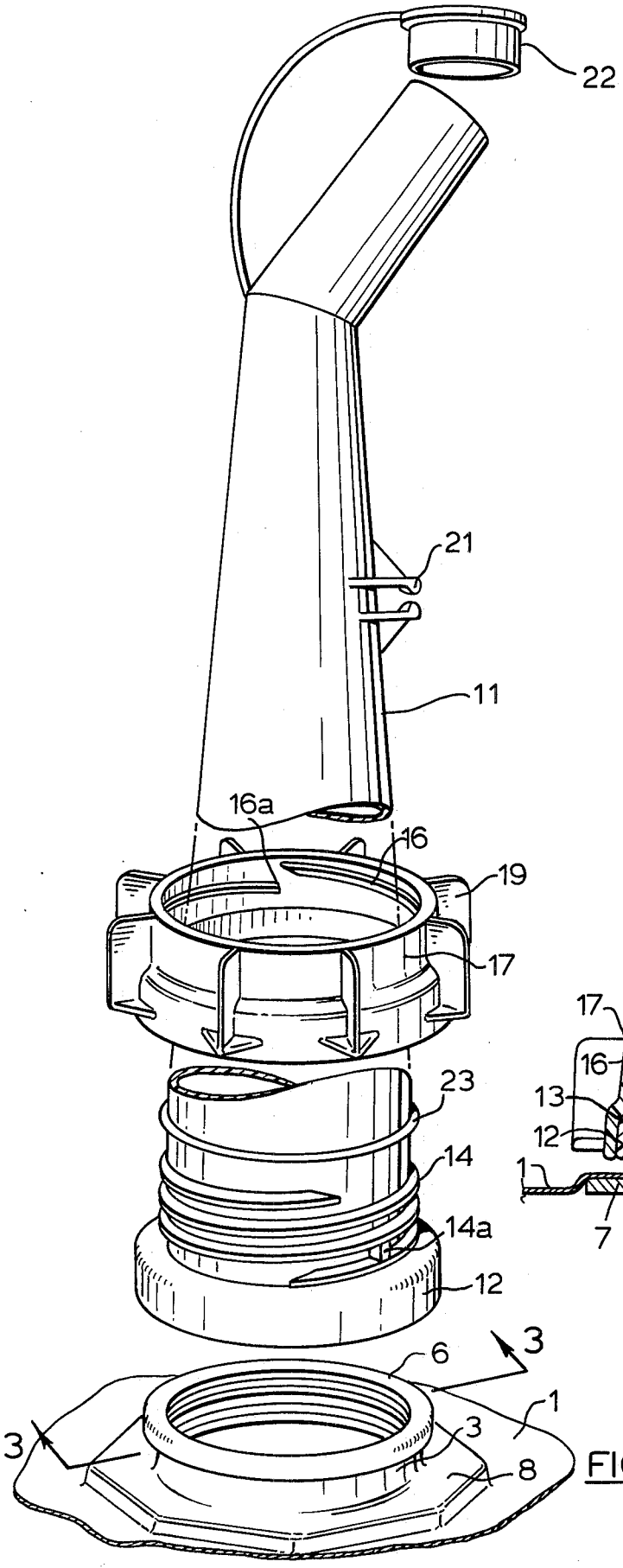
FIG. 2 is an enlarged view showing the spout and the cooperating connecting part of the container.
Figure 1:
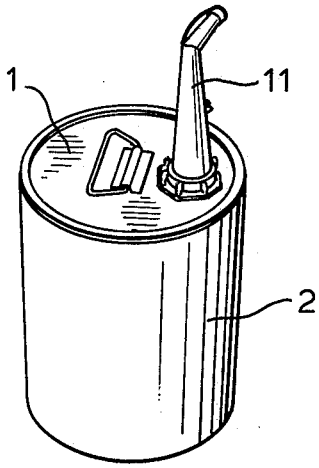
FIG. 1 shows a spout in accordance with the invention connected on a gasoline container.

In the drawings, the flat metal top 1 of the container 2, which in the form illustrated may be a metal gasoline can, is formed with an upwardly extending neck 3 providing a pouring aperture. In manufacture of the top 1 a metal sleeve or insert 4 is applied on the underside of the neck 3 and has its upper rim rolled over together with the upper edge of the neck 3 to provide an outwardly protruding circumferential bead 6 at the upper end of the neck 3. The rolling operation tightly clamps the insert 4 to the top 1, with octagonal flange 7 at the base of the insert 4 seated in a corresponding octagonal embossment 8 in the top 1. The inner surface of the insert 4 is threaded at 9 to receive a threaded closure used during storage or transport.

For various reasons, it may be preferred to have no projection within the interior of the neck 3 when the spout 11 is connected on the container top. Thus, for example, a strainer may be fitted to the underside of the container top underneath the neck 3, and this may preclude any portion of the spout 11 extending any significant depth into the container.

Figure 3:
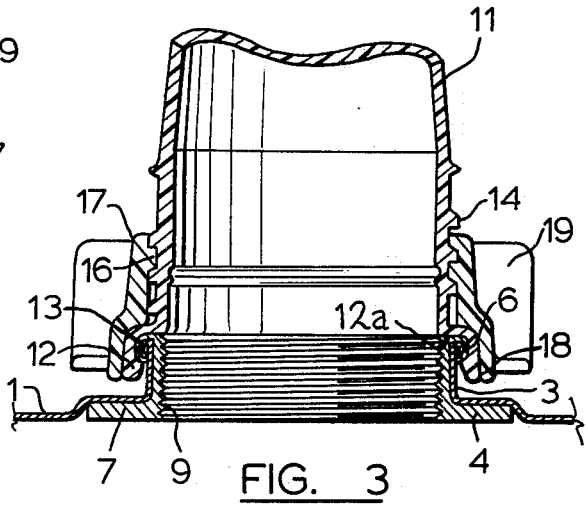
FIG. 3 is a cross-section on the line 3—3 of FIG. 2.

In the embodiment illustrated, the tapering hollow spout 11 which is formed as a plastics moulding from a stiffly bendable plastics, e.g. from relatively thick polyethylene, has at its lower end a flared skirt 12 formed with a circumferentially continuous groove 13 dimensioned so as snap-fit tightly onto the bead 6 of the neck 3. Upwardly from the skirt 12, the inner surface of the spout 11 includes a downwardly-facing shoulder portion **12*a*, and this seats in liquid-tight sealing engagement on the top of the neck 3 when the skirt 12 is snapped onto the bead 6. Above the shoulder portion 12*a*, the spout 11 carries an external thread 14 matching an internal thread 16 on a locking collar 17 placed over the spout 11. At its lower end the collar 17 is formed with a smooth circumferential cylindrical shoulder 18 conforming generally with the outer surface of the skirt 12 and has external hand grips 19 to assist in tightening the collar 17 down into the locking position shown in FIG. 3. The thread on the collar 17 and/or on the spout 11** may be formed with a stop to prevent over-tightening of the collar.

In the example shown in the drawing the thread 14 on the spout 11 has an interruption in the form of a small protruding block portion **14*a* moulded integrally with the spout which engages with a blunt end 16*a* of the thread 16 on the collar 17** to prevent tightening beyond the desired point.

At an upper part, the spout 11 has flexible jaws 21 for clipping the spout on the rim of the container top 1 when not in use, and an integrally connected closure cap 22 is provided for the end of the spout 11.

A short distance above the thread 14 the spout 11 has a circumferential rib 23 which interferes with the thread 16 on the collar 17 and retains the collar 17 below the rib 23 in normal use.

The locking collar 17 is moulded of plastics e.g. polypropylene and at least in the region of its shoulder 18 is stiffer than the material of the skirt 12. Thus in use, when the skirt 12 is snap-fitted over the bead 6, the skirt 12 will be firmly retained against deflection and uncoupling when the collar 17 is tightened down into the position shown in FIG. 3.

In the example shown, the skirt 12 is circumferentially continuous, but it may be interrupted by narrow vertical slots as long as these are narrow in relation to the portions of the skirt extending between the slots, so that the portion of the skirt 12 below the groove 13 is substantially continuous and is not greatly weakened preferably with the aggregate extent of the slots, if any, being in total no more than about 20% of the circumference of the skirt 12. By virtue of the configuration of the skirt 12, the skirt snaps tightly over the bead 6.

The connection which is obtained has considerable strength, capable of resisting the leverage exerted against the spout when the spout is used to prop the weight of the container when pouring liquid from the full container into some receptacle. On release of the locking collar 17, the spout 11 can be levered off the bead 6 by hand pressure.

Other configurations within the scope of the invention can of course be used. Thus for example, a bayonet fitting instead of a screw-thread can be used to retain a locking collar or other locking member in a position resisting deflection of the flexible part of the snap coupling.

We claim:

1. A container having in its top a pouring aperture bounded by a raised metal neck with an outwardly turned bead, a spout releasably retained on the neck comprising a one-piece moulding of stiffly bendable plastics material comprising at one end a flared skirt with a circumferentially-continuous internal groove in tight snap-fitting connection on said bead, said skirt having a generally cylindrical exterior surface extending from the bottom edge of the spout upward to an inwardly stepped shoulder portion that engages sealingly on the top of the metal neck, an externally threaded intermediate portion above the stepped portion, and an elongated upper portion tapering from the threaded portion to a relatively slender elongated pouring outlet portion at the end remote from the skirt, said groove levering off from and disconnecting from said snap-fitting connection with the bead by application of normal hand pressure to the upper and outlet portions, and a locking collar moulded from plastics stiffer than the plastics material of the spout and comprising an upper end part threaded on said threaded portion, and a lower sleeve having an inner cylindrical surface extending over the skirt in tightly abutting engagement with the entire exterior cylindrical surface of the skirt and resisting outward flexure of the skirt so as to prevent said levering disconnection until the collar is rotated to retract the sleeve upwardly from said cylindrical surface.

2. A container as claimed in claim 1 having a screw thread on the interior of the neck.

3. A container as claimed in claim 1 in which the thread on one of the spout and the locking member has a stop preventing over-tightening.

4. A container as claimed in claim 1 having a generally flat metal top, said neck being formed by a metal insert having an upper rim rolled over together with the metal of the top to form an outwardly protruding circumferential bead.

* * * * *